US005088681A

United States Patent [19]

Procaccianti et al.

[11] Patent Number: 5,088,681

[45] Date of Patent: Feb. 18, 1992

[54] ANCHOR DEVICE

[75] Inventors: Rudolph J. Procaccianti, 134 Kenyon Ave., East Greenwich, R.I. 02818; Bartolo Rizzo, Providence, R.I.

[73] Assignee: Rudolph J. Procaccianti, East Greenwich, R.I.

[21] Appl. No.: 702,593

[22] Filed: May 17, 1991

[51] Int. Cl.[5] ..... A01K 97/10

[52] U.S. Cl. ..... 248/530; 248/545; 248/156; 52/157

[58] Field of Search ..... 248/530–533, 248/545, 156; 52/155, 156, 157

[56] References Cited

U.S. PATENT DOCUMENTS

| | | | |
|---|---|---|---|
| 3,986 | 4/1845 | Mitchell | 52/157 |
| 513,115 | 1/1894 | Kiler | 52/157 |
| 1,883,477 | 10/1932 | Bash | 52/157 |
| 3,831,891 | 8/1974 | Jester | 248/545 X |
| 4,334,392 | 6/1982 | Dziedzic | 52/157 |
| 4,467,575 | 8/1984 | Dziedzic | 52/157 |
| 4,656,774 | 4/1987 | Terrill | 248/545 X |

FOREIGN PATENT DOCUMENTS

| | | | |
|---|---|---|---|
| 635111 | 2/1962 | Italy | 248/545 |
| 3442 | of 1868 | United Kingdom | 52/157 |

*Primary Examiner*—Alvin C. Chin-Shue
*Attorney, Agent, or Firm*—Salter & Michaelson

[57] ABSTRACT

Anchor device for use on the stake of a beach umbrella, including a main body having a semi-circular cross-section and a flight that extends helically around the main body and is fastened to it at two longitudinally-spaced position lines of contact therewith.

2 Claims, 1 Drawing Sheet

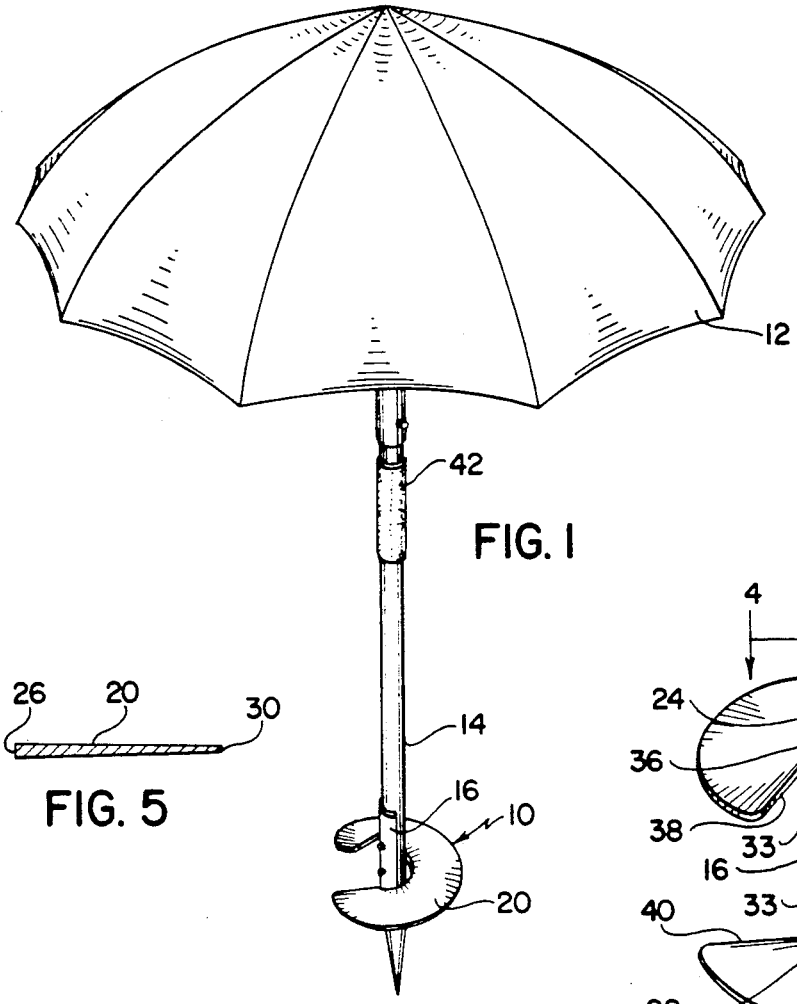
FIG. 1
FIG. 5
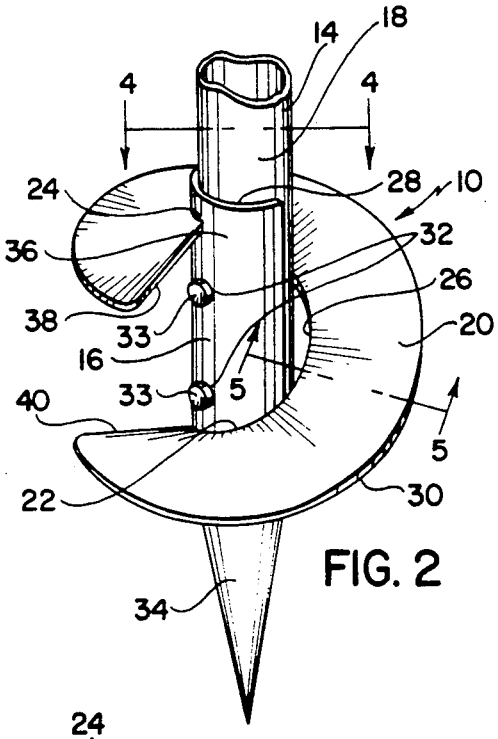
FIG. 2
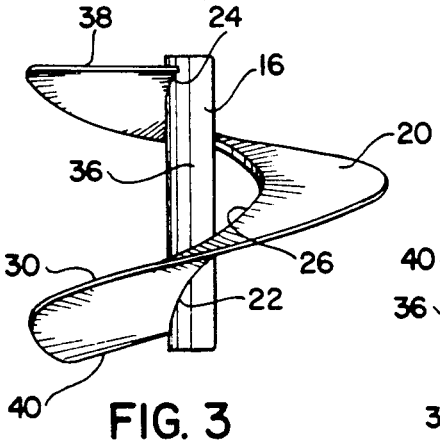
FIG. 3
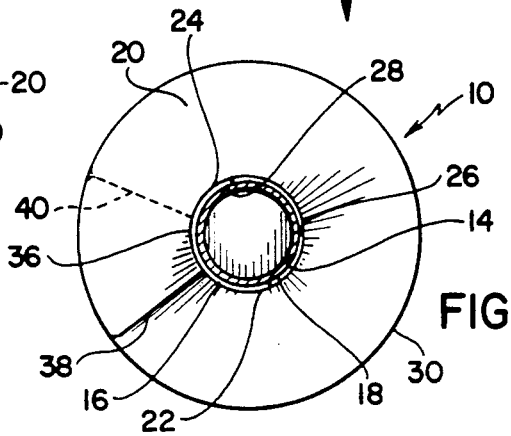
FIG. 4

ANCHOR DEVICE

BACKGROUND OF THE INVENTION

For many years, it has been customary, when spending a day at the beach, to make use of a large umbrella to provide protection from the sun. Usually, such beach umbrellas are provided with a long staff or stake that can be driven into the sand. This stake is intended to locate the umbrella firmly in place and to permit a determination of the angle at which the umbrella is to be directed.

Unfortunately, even though the umbrella would remain in the selected position in still air, at an ocean beach the wind is usually very strong. The result is that beach umbrellas are often lifted out of the sand and carried away. Not only is this a nuisance, but the danger to other persons on the beach is evident, particularly because of the fact that the umbrella has various sharp protuberances.

Attempts have been made in the past to cure this defect in conventional beach umbrellas in various ways; one of the common suggestions involves providing the umbrella pole with a screw-type extension. For instance, the U.S. Pat. No. to SNOOK #1,736,177 shows a tubular socket for receiving the umbrella pole, which socket is provided with a cast screw at the lower end. The U.S. Pat. No. to JONES #2,103,948 describes a pointed socket for application to the lower end of the umbrella staff, which socket is provided with a helical threads. The U.S. Pat. No. to BEITER #2,209,504 concerns a cast staff tip that is formed with a deep double helix. The U.S. Pat. No. to MERCER #2,211,283 describes an attachment for an umbrella staff that includes a threaded auger-like tip. In the U.S. Pat. No. to WARTH #3,286,962, the staff socket is provided with an open helical skewer, while the U.S. Pat. No. to SHPIGEL et al #4,819,904 shows an attachment for the bottom of an umbrella pole that has a flat helical screw-thread formation, and the U.S. Pat. No. to MORGULIS #4,832,304 shows a ground-anchoring device for umbrellas that has spiral threads.

It is evident that these prior art devices lack several qualities to make them effective, including the fact that their screw threads are, because of the fabrication method used, of small lateral extent. This means that, although they can be buried easily in the sand, they do not grip well enough to resist the strong action of the ocean breeze on the umbrella. In addition, they are clearly expensive and excessively complicated. They are generally effective in aiding in the driving of the stake into the ground, but they lack the ability to hold effectively when buried in a sandy beach. These and other difficulties experienced with the prior art devices have been obviated in a novel manner by the present invention.

It is, therefore, an outstanding object of the invention to provide an anchor device that is very effective in resisting wind forces on an umbrella at the beach.

Another object of this invention is the provision of an anchor device that can be used in converting an ordinary umbrella pole or stake to one which can be useful at an ocean beach.

A further object of the present invention is the provision of an anchor kit for application easily to an umbrella stake.

A still further object of the invention is the provision of an anchor device which is simple and rugged in construction, which can be easily manufactured from readily-available materials, and which is capable of providing a long life of useful service with a minimum of maintenance.

It is a further object of the invention to provide an anchor screw that will operate well in sand, so that it can be used with a beach umbrella to establish the umbrella firmly in place.

Another object of the invention is the provision of an anchor device that can be used on umbrella staffs of various diameters.

With these and other objects in view, as will be apparent to those skilled in the art, the invention resides in the combination of parts set forth in the specification and covered by the claims appended hereto.

SUMMARY OF THE INVENTION

In general, the present invention relates to an anchor device for application to a beach umbrella having a pointed stake, the device having an elongated main body with a cross-sectional shape that is a semi-circle. A helical flight is fastened to the outer surface of the main body at two longitudinally-spaced position lines.

More specifically, the flight terminates on the main body at the said position lines and the flight ends in straight edges that are radial to the cylindrical outer surface of the main body at locations that are close to a longitudinal line. The flight has an inner edge that passes helically along an imaginary cylindrical surface constituting an extension of the outer surface of the main body.

BRIEF DESCRIPTION OF THE DRAWINGS

The character of the invention, however, may be best understood by reference to one of its structural forms, as illustrated by the accompanying drawings, in which:

FIG. 1 is a perspective view of an anchor device incorporating the principles of the present invention and shown in use with a beach umbrella having a stake;

FIG. 2 is an enlarged fragmentary perspective view of the anchor device mounted on the bottom portion of the stake;

FIG. 3 is an elevational view of the anchor device per se;

FIG. 4 is a sectional view taken on the line 4—4 of FIG. 2; and

FIG. 5 is a sectional view taken on the line 5—5 of FIG. 2.

DESCRIPTION OF THE PREFERRED EMBODIMENT

Referring first to FIG. 1, which best shows the general features of the invention, the anchor device, indicated generally by the reference numeral 10, is shown in use with a beach umbrella 12 having a stake 14. The anchor device consists of an elongated main body 16 fastened to a cylindrical surface 18 on the stake, and further comprises a helical flight 20 secured to said main body.

The details of construction of the anchor device are best shown in FIGS. 2, 3, and 4. The main body 16 has a semi-circular cross-section, and the helical flight 20 is fastened to its outer surface 36 at two longitudinally-spaced position lines 22 and 24

The helical flight 20 has an inner edge 26 that passes helically along an imaginary cylindrical surface which constitutes an extension of the outer surface of the main body, or in other words, edge 26 is in spaced relation to surface 36. The flight has an outer edge 30 which passes helically along an imaginary cylindrical surface that is coaxial to the first-mentioned imaginary cylindrical surface and has a substantially larger diameter.

In the preferred embodiment of the invention, the main body 16 and the helical flight 20 are formed of steel and the inner edge of the flight is welded to the main body along substantial lines of contact therewith. Other suitable materials could, of course, be used.

As shown in FIG. 5, the flight 20 has a cross section that tapers from a substantial thickness at the inner edge 26 to a substantially lesser thickness at the outer edge 30. The main body is provided with longitudinally spaced apertures 32 for fastening it to the stake by screws 33 or the like. The helical flight 20 terminates on the main body at the position lines 22 and 24, the points of termination being close to the same generatrix of the cylindrical outer surface 36. The flight terminates at both ends in straight edges 38 and 40 which are radial to the cylindrical outer surface 36 of the main body. It is convenient and useful to apply a band 42 of a high-friction sheet material to the stake 14 to surround it at a position spaced longitudinally a substantial distance above the anchor device.

The operation and advantages of the invention will now be readily understood in view of the above description. The anchor device 10 is applied to the stake 14 of the beach umbrella 12 by running screws 33 through the apertures 32 of the main body 16 into the stake. If the stake is wooden, the fastening can take place either with nails or with wood screws. If, however, the stake is made of tubular metal, as shown in FIG. 2, it may be desirable to use self-tapping metal screws. In either case, the anchor device has the helical flight 20 arranged to constitute a right-hand screw and to permit entry into the sand by rotating the stake in the clockwise direction. First, however, the pointed end 34 of the stake 14 is pushed into the sand until the edge 40 of the flight 20 touches the sand. At that time, the rotation mentioned above will produce downward progress of the stake into the sand with little effort, especially when assisted by grasping the band 42 of high-friction material. In the preferred embodiment of the invention, the stake 14 is tubular and forms with the anchor device a unit that can be separated from the remainder of the beach umbrella for storage and transportation. As is evident in FIG. 4, the inner surface 28 of the main body 16 is part of a cylindrical surface that has a somewhat larger diameter than that of the cylindrical surface 18 of the stake; in this way, the main body 16 is adaptable to stakes having various diameters.

It can be seen, then, that the anchor device of the invention can be manufactured and sold as part of a beach umbrella and its stake or, alternatively, it can be sold separately as a "kit" which the purchaser can attach to a beach umbrella which he or she already owns. In either case, the unit is very easy to screw into the sand and, when in place, will prevent the umbrella from being carried away by a strong wind. This not only does away with the nuisance of being required to chase the umbrella, but it prevents a dangerous situation from developing in which the umbrella with its sharp elements would otherwise be flying through the air or tumbling along the beach. The provision of the substantial gap that normally exists between the inner edge 26 of the helical flight 20 and the surface 18 of the stake serves to reduce a tendency for sand to accumulate along the flight. The arrangement also makes the anchor device adaptable to different size stakes without interference. An examination of the construction of the invention will make it evident that the anchor device is simple and inexpensive to manufacture and that it is rugged enough to withstand rough treatment without damage. Naturally, the main body with its helical flight can be removed temporarily from the beach umbrella, if desired, for the purpose of storage. It can be removed when the umbrella is to be used in a situation where the anchor device cannot be used or its presence is otherwise undesirable or unnecessary.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Anchor device for use with a beach umbrella or the like having a pointed stake, comprising (a) an elongated main body having a semi-circular cross-sectional shape;

(b) means fastening said body to the surface of the stake adjacent to but spaced from the pointed end thereof whereby the pointed end is exposed for penetration into the ground;

(c) a helical flight; and (d) means fastening said flight to the outer surface of said body at two longitudinally spaced positions, which positions are adjacent the extremities of said flight.

2. Anchor device as recited in claim 1, wherein said inner edge extends helically around an imaginary cylindrical surface that constitutes an extension of the outer surface of said main body, whereby the portion of said inner edge that is not in engagement with said main body is spaced a substantial distance from the surface of the stake.

* * * * *